US011771192B2

(12) United States Patent
Moore et al.

(10) Patent No.: US 11,771,192 B2
(45) **Date of Patent: *Oct. 3, 2023**

(54) METHOD AND APPARATUS FOR MANIPULATING THE SHAPE OF HAIR

(71) Applicant: Jemella Limited, Leeds (GB)

(72) Inventors: Timothy David Moore, Hertfordshire (GB); Roger James Williamson, Leeds (GB)

(73) Assignee: Jemella Limited, Leeds (GB)

( * ) Notice: Subject to any disclaimer, the term of this patent is extended or adjusted under 35 U.S.C. 154(b) by 546 days.

This patent is subject to a terminal disclaimer.

(21) Appl. No.: 16/897,773

(22) Filed: Jun. 10, 2020

(65) Prior Publication Data

US 2020/0297091 A1 Sep. 24, 2020

Related U.S. Application Data

(63) Continuation of application No. 15/539,616, filed as application No. PCT/GB2015/054154 on Dec. 23, 2015, now Pat. No. 10,716,381.

(30) Foreign Application Priority Data

Dec. 23, 2014 (GB) ..... 1423039

(51) Int. Cl.
*A45D 1/28* (2006.01)
*A45D 1/04* (2006.01)
(Continued)

(52) U.S. Cl.
CPC ..... *A45D 1/28* (2013.01); *A45D 1/04* (2013.01); *A45D 2/001* (2013.01); *A45D 2/40* (2013.01);
(Continued)

(58) Field of Classification Search
CPC ... A45D 2/00; A45D 1/04; A45D 7/02; A45D 1/28; A45D 7/06; A45D 2001/045;
(Continued)

(56) References Cited

U.S. PATENT DOCUMENTS 2,892,915 A 6/1959 Gard et al.
4,242,567 A 12/1980 Carter
(Continued)

FOREIGN PATENT DOCUMENTS

CN 1630478 A 6/2005
CN 1638667 A 7/2005
(Continued)

OTHER PUBLICATIONS

"U.S. Appl. No. 15/539,616, Examiner Interview Summary dated Mar. 5, 2020", 3 pgs.
(Continued)

*Primary Examiner* — Tu B Hoang
*Assistant Examiner* — Vy T Nguyen
(74) *Attorney, Agent, or Firm* — Schwegman Lundberg & Woessner, P.A.

(57) ABSTRACT

Apparatus for manipulating the shape of hair using dielectric heating is provided. Typically, the apparatus comprises opposing first and second electrodes respectively provided on first and second arms that are movable towards and away from one another; and drive circuitry for supplying electrical energy to the first and second electrodes, to cause an alternating electric field to be produced in the vicinity of the electrodes in use, and thereby cause dielectric heating of hair placed between the electrodes in use. Sensing circuitry may also be provided for sensing a change in coupling of energy from the alternating electric field to the hair during heating of the hair; and control circuitry for controlling the drive circuitry to vary the electrical energy supplied to the first and
(Continued)

second electrodes in dependence upon the sensed change in coupling. A related method of manipulating the shape of hair using dielectric heating is also provided.

13 Claims, 6 Drawing Sheets

(51) Int. Cl.

| | |
|---|---|
| ***A45D 2/00*** | (2006.01) |
| ***A45D 7/02*** | (2006.01) |
| ***H05B 6/54*** | (2006.01) |
| ***H05B 6/62*** | (2006.01) |
| ***A45D 2/40*** | (2006.01) |
| ***A45D 6/20*** | (2006.01) |

(52) U.S. Cl.
CPC ..... *A45D 6/20* (2013.01); *A45D 7/02* (2013.01); *H05B 6/54* (2013.01); *H05B 6/62* (2013.01); *A45D 2001/045* (2013.01)

(58) Field of Classification Search
CPC ..... A45D 2/40; A45D 6/20; A45D 2001/008; A45D 2200/207; A45D 7/00; A45D 1/00; A45D 24/00; A45D 4/14; A45D 6/00; H05B 6/54; H05B 6/62; H05B 6/00; H05B 6/60
USPC ..... 219/222, 678, 764, 773–778; 132/229; 235/435, 449–450, 462, 487–493
See application file for complete search history.

(56) References Cited

U.S. PATENT DOCUMENTS

| | | | | |
|---|---|---|---|---|
| 4,258,240 | A | 3/1981 | Pless | |
| 4,531,038 | A | 7/1985 | Lillibridge et al. | |
| 4,819,674 | A | 4/1989 | Takimae | |
| 5,093,546 | A | 3/1992 | Matsumiya et al. | |
| 10,716,381 | B2 | 7/2020 | Moore et al. | |
| 2003/0205571 | A1 | 11/2003 | Flugstad et al. | |
| 2007/0056960 | A1* | 3/2007 | Bell | A45D 2/36 219/678 |
| 2008/0007273 | A1 | 1/2008 | Sherman et al. | |
| 2011/0259953 | A1* | 10/2011 | Baarman | G01G 7/00 235/375 |
| 2012/0312319 | A1 | 12/2012 | Uwano | |
| 2013/0003061 | A1 | 11/2013 | Wandke et al. | |
| 2016/0338755 | A1 | 11/2016 | Holbeche et al. | |
| 2017/0360174 | A1 | 12/2017 | Moore et al. | |

FOREIGN PATENT DOCUMENTS

| | | | | | |
|---|---|---|---|---|---|
| CN | 102917485 | A | | 2/2013 | |
| DE | 3115569 | A1 | | 12/1982 | |
| DE | 102009045498 | A1 | | 4/2011 | |
| EP | 0592979 | A1 | | 4/1994 | |
| GB | 589911 | A | | 7/1947 | |
| GB | 2016051 | A | | 9/1979 | |
| GB | 2163574 | A | | 2/1986 | |
| GB | 2318544 | A | | 4/1998 | |
| GB | 2500733 | A | * | 10/2013 | A45D 1/00 |
| GB | 2533602 | A | | 6/2016 | |
| KR | 1020090119155 | A | | 11/2009 | |
| WO | WO-2011141882 | A1 | | 11/2011 | |
| WO | WO-2013176125 | A1 | | 11/2013 | |
| WO | WO-2013183021 | A1 | | 12/2013 | |
| WO | WO-2016102972 | A2 | | 6/2016 | |
| WO | WO-2016102972 | A3 | | 6/2016 | |

OTHER PUBLICATIONS

"U.S. Appl. No. 15/539,616, Non Final Office Action dated Nov. 15, 2019", 30 pgs.
"U.S. Appl. No. 15/539,616, Notice of Allowance dated May 4, 2020", 19 pgs.
"U.S. Appl. No. 15/539,616, Preliminary Amendment filed Jun. 23, 2017", 11 pgs.
"U.S. Appl. No. 15/539,616, Response filed Apr. 14, 2020 to Non Final Office Action dated Nov. 15, 2019", 15 pgs.
"U.S. Appl. No. 15/539,616, Response filed Oct. 28, 2019 to Restriction Requirement dated Oct. 3, 2019", 10 pgs.
"U.S. Appl. No. 15/539,616, Restriction Requirement dated Oct. 3, 2019", 8 pgs.
"Chinese Application Serial No. 201580069699.X, Office Action dated Jan. 2, 2020", w/English Translation, (dated Jan. 2, 2020), 15 pgs.
"International Application Serial No. PCT/GB2015/054154, International Preliminary Report on Patentability dated Jul. 6, 2017", 15 pgs.
"International Application Serial No. PCT/GB2015/054154, International Search Report dated Jul. 18, 2016", 7 pgs.
"International Application Serial No. PCT/GB2015/054154, Written Opinion dated Jul. 18, 2016", 13 pgs.
"United Kingdom Application Serial No. 1423039.5, Office Action dated Jun. 8, 2015", 5 pgs.
"United Kingdom Application Serial No. 1720073.4, Combined Search and Examination Report dated Jan. 30, 2018", 7 pgs.
"U.S. Appl. No. 15/539,616, Corrected Notice of Allowability dated Jun. 25, 2020", 16 pgs.
"Chinese Application Serial No. 201580069699.X, Office Action dated Jul. 9, 2020", w/English Translation, (dated Jul. 9, 2020), 11 pgs.

* cited by examiner

METHOD AND APPARATUS FOR MANIPULATING THE SHAPE OF HAIR

CLAIM FOR PRIORITY

This application is a continuation of U.S. application Ser. No. 15/539,616, filed Jun. 23, 2017, which is a U.S. National Stage Filing under 35 U.S.C. 371 from International Application No. PCT/GB2015/054154, filed Dec. 23, 2015, and published as WO2016/102972 on Jun. 30, 2016, which claims the benefit of priority to Great Britain Patent Application No. 1423039.5, filed Dec. 23, 2014, the content of each of which are incorporated herein by reference in their entireties.

FIELD OF THE INVENTION

The present invention relates to a method and apparatus for manipulating the shape of hair, for example in order to style the hair. Such manipulation or styling of the hair may be performed by a user on their own hair, for example, or by a hair stylist.

BACKGROUND TO THE INVENTION

It is known for persons to employ electric hair stylers to manipulate the shape of hair. Common electric hair stylers employ one or more resistive heating elements incorporated within heating plates that are carried by opposed jaws. Such resistive heating elements generate heat by passing an electric current through a resistive material, which causes the heating plates to heat up (typically to a temperature of around 210° C.). It will be appreciated that the heating plates when hot can potentially represent a safety risk to the user (or to others, such as children, who may come into contact with the styler), either during operation of the styler or once it has been turned off but is still at temperature.

Furthermore, the styler needs to be engineered to withstand the temperature of the heating plates when they have heated up. Accordingly, temperature resistant materials such as glass reinforced plastic are commonly required to support the heating plates. Such materials can be relatively costly to obtain and then form into the required shape. Consequently there is a desire to be able to use materials that are less expensive to obtain and form.

SUMMARY OF INVENTION

The present invention aims to provide alternative apparatus and methods for manipulating the shape of hair. The invention uses dielectric heating to manipulate the shape of hair. Dielectric heating is a known technique to heat electrically non-conductive materials, whereby energy from an alternating electric field is coupled to a dielectric medium to heat it. Dielectric heating can be particularly useful for heating poor thermal conductors, where applying a high heat could cause charring. For example, it is sometimes used in the wood industry for drying the glue in plywood, where charring of the surface of the wood is not desired.

In the context of the present invention, dielectric heating is used to heat hair, causing the hair to heat up without the plates of the styler heating up excessively—thereby providing a safer device for the user (or anyone else who may inadvertently touch the plates during or after operation). The use of dielectric heating on hair is also believed to have a further benefit in manipulating the hydrogen bonds within the hair at lower temperatures, thus effectively lowering the glass transition phase temperature of the hair, allowing shape definition at lower temperatures of around 60° C. to 80° C.

To heat the hair dielectrically, the hair is placed between two electrode plates (in the manner of a capacitor), such that the hair acts as a dielectric medium between the plates. An alternating electric field is applied between the plates, which forces molecular alignment in the hair. The alignment of the molecules causes vibrations or phonons, and hence the temperature of the hair increases: there is heat generation.

It has been found that pure dielectric materials are not ideal for use with dielectric heating, since they dissipate little amounts of heat. However, materials with polar bonds (and water), such as hair, particularly damp or moist hair, interact with the field more strongly, thus increasing the amount of heat dissipated (the so-called "dissipation factor").

Accordingly, dielectric heating is well suited to the heating of hair, to enable the hair to be manipulated or styled. However, for optimum heating of the hair, the energy from the alternating electric field should be efficiently coupled to the hair, otherwise poor performance can be obtained.

In this respect, the present inventors have found that the coupling of energy from the alternating electric field to the hair depends on the frequency of the alternating field and that the peak absorption frequency of the hair (i.e. the frequency of the alternating electric field at which the energy from the electric field optimally couples to the hair) is not constant, but changes as the moisture content of the hair decreases during the heating process. Furthermore, the level of absorption drops rapidly either side of the peak absorption frequency, giving a very narrow absorption peak when viewed on a plot of absorption level against frequency. Consequently, during the application of an alternating electric field at any given frequency, energy will only be optimally coupled to the hair temporarily, and once the peak absorption frequency of the hair has changed, the level of energy absorption (and thus the efficiency of the process, and the level of heating achieved in the hair) will be notably decreased. A further complication is that the peak absorption frequency and the width of the absorption peak also vary with the packing density of the hair.

According to a first aspect of the present invention there is provided styler apparatus for manipulating the shape of hair that uses dielectric heating. The apparatus will typically comprise: first and second arms that are movable towards and away from one another; first and second electrodes provided on the first and second arms respectively, such that the electrodes oppose one another; and drive circuitry for supplying electrical energy to the first and second electrodes, to cause an alternating electric field to be produced in the vicinity of the electrodes in use, and thereby cause dielectric heating of hair placed between the electrodes in use. In preferred embodiments, the apparatus also comprises sensing circuitry for sensing a change in coupling of energy from the alternating electric field to the hair during heating of the hair; and control circuitry for controlling the drive circuitry to vary the electrical energy supplied to the first and second electrodes in dependence upon the sensed change in coupling.

By virtue of the sensing circuitry and the control circuitry, the present styler apparatus is able to maintain efficient coupling of energy from the alternating electric field to the hair, even if the peak absorption frequency of the hair changes during the styling process, and despite the peak absorption frequency and the width of the absorption peak varying with the packing density of the hair.

In the presently-preferred embodiments the control circuitry is configured to control the drive circuitry to vary a frequency of the electrical energy supplied to the first and second electrodes.

Preferably the sensing circuitry further comprises means for determining a frequency of the electrical energy at which better coupling of the alternating electric field to the hair takes place than with other frequencies; and the control circuitry is further configured to control the drive circuitry to adjust the frequency of the electrical energy so as to be at or around the determined frequency. Preferably, the means for determining determines the frequency of the electrical energy which provides optimal or near optimal coupling of the alternating electric field to the hair.

The means for determining may comprise means for sensing the current drawn by the electrodes in dependence on the frequency of the supplied electrical energy, wherein the determined frequency is the frequency of the supplied electrical energy at which the magnitude of the sensed current is substantially at a peak. Sensing the current drawn as a function of frequency provides a relatively straightforward way of determining which frequency of the supplied electrical energy causes coupling of the alternating electric field to the hair.

The means for sensing the current drawn by the electrodes may be configured to generate a feedback signal representative of the magnitude of the current drawn by the electrodes. Further the control circuitry may be configured to cause the drive circuitry to vary the frequency of the electrical energy such as to supply test signals to the electrodes at a plurality of different frequencies across a range of frequencies; wherein the control circuitry is configured to receive said feedback signal in respect of each of the plurality of frequencies and thereby determine the frequency of the electrical energy at which a peak in the sensed current is obtained; and wherein the control circuitry is configured to cause the drive circuitry to supply the electrical energy at or around the determined frequency for a period of time.

In one possible variant, the control means are configured to vary the frequency of the electrical energy using a frequency hopping technique across the range of frequencies. The frequency hopping may be performed on a pseudorandom basis or according to a predetermined pattern or sequence.

In another possible variant, the control means are configured to vary the frequency of the electrical energy in a sweeping manner across the range of frequencies.

In yet another possible variant, the control means are configured to apply a test signal to the electrodes comprising a plurality of frequencies simultaneously. For example, a wide band test signal may be applied. The control circuitry may be configured to determine, via frequency analysis of the overall current applied to the electrode, the frequency of a component of the overall current that is greater in magnitude than the other components. Thus, such a technique operates in the frequency domain, directly analysing the frequency components of the current that is drawn by the electrodes as a result of the multi-frequency test signal.

The control circuitry may be configured to cause the drive circuitry to generate the test signal or test signals comprising the different frequency components whilst substantially simultaneously supplying electrical energy to the electrodes at the (previously) determined frequency to cause heating of the hair. In such a manner, the heating of the hair is not interrupted by the generation and application of the test signals (even though the test signals would be generated and applied very quickly in practice). The test signals are preferably at a low amplitude relative to the electrical energy supplied at the determined frequency.

In all the above examples, the range of frequencies is preferably from around 1 MHz to around 100 MHz. More preferably the range of frequencies is from around 10 MHz to around 100 MHz. Even more preferably the range of frequencies is from around 20 MHz to around 40 MHz, these frequencies being well suited for consumer products since they have limited wave propagation (unlike microwaves) and hence do not present a risk to health or undesirable EMC (electromagnetic compatibility) effects.

To maintain efficient coupling of energy from the alternating electric field to the hair, despite the peak absorption frequency of the hair changing during the styling process, the control means are preferably configured to successively repeat the determining process after the said period of time has elapsed, and thereby repeatedly adjust the frequency at which the electrical energy is supplied to the electrodes.

As a safety precaution the apparatus may further comprise means for detecting whether the first and second arms are closed together, and means for cutting off the supply of electrical energy to the electrodes if the first and second arms are not detected as being closed together.

Preferably the opposing surfaces of the first and second electrodes are coated in or covered by a non-conductive material to prevent the electrodes from coming into electrical contact with one another when the first and second arms are brought towards one another in use, thereby preventing a short circuit from occurring should the electrodes come into contact with each another.

In certain embodiments a plastics material is provided between the opposing surfaces of the first and second electrodes.

Indeed, as a consequence of the lower operational temperatures of the present electrodes in comparison to conventional resistive electrodes, each electrode may be mounted on, or embedded in, a plastic region of the respective arm. Moreover, the arms may be substantially entirely formed of a plastics material (without glass or other reinforcement), thereby enabling the apparatus to be made inexpensively and also reducing its weight.

In certain embodiments the first arm may bear a first dielectric heating plate, and the second arm may bear a second dielectric heating plate, the first dielectric heating plate incorporating the first electrode and the second dielectric heating plate incorporating the second electrode. At least the first dielectric heating plate may have a plastic outer surface which forms a contact surface for hair sandwiched between the plates during use.

More generally, in certain embodiments each of the electrodes may be substantially rectangular in shape. However, in alternative embodiments the electrodes may be configured differently. In one such example, each of the electrodes comprises a first conductive region interdigitated with a second conductive region; the first conductive region of the first electrode opposes the first conductive region of the second electrode; the second conductive region of the first electrode opposes the second conductive region of the second electrode; and the drive circuit is configured to drive the first and second conductive regions of each electrode with complementary drive signals (e.g. drive signals that are substantially 180 degrees out of phase with one another). Such an arrangement has been found to help "focus" the electric field onto the hair, providing enhanced coupling of the energy into the hair, reducing stray field lines, and also reducing potential radiofrequency emissions.

To aid coupling between the apparatus and hair, preferably the output impedance of the drive circuitry is matched to the capacitive impedance formed by the electrodes and the hair between the electrodes in use. To this end, preferably the output impedance of the drive circuitry is of the order of 1-10 ohms. Particularly preferably the output impedance of the drive circuitry is of the order of 1.5 ohms to 5 ohms. Even more preferably the output impedance of the drive circuitry is about 2 ohms.

According to a second aspect of the invention there is provided a method of manipulating the shape of hair that uses dielectric heating. Typically, the method comprises: placing hair between first and second electrodes provided on respective first and second arms of a styler apparatus, the electrodes opposing one another, and the first and second arms being movable towards and away from one another; and supplying electrical energy to the first and second electrodes, to cause an alternating electric field to be produced in the vicinity of the electrodes, and thereby cause dielectric heating of the hair. In preferred embodiments, the method further comprises: sensing a change in coupling of energy from the alternating electric field to the hair during heating of the hair; and varying the electrical energy supplied to the first and second electrodes in dependence upon the sensed change in coupling.

Preferable or optional features in relation to the second aspect of the invention broadly correspond to those as discussed above in relation to the first aspect of the invention.

According to a third aspect of the invention there is provided apparatus for manipulating the shape of hair using dielectric heating, the apparatus comprising: first and second arms that are movable towards and away from one another; and first and second electrodes provided on the first and second arms respectively, such that the electrodes oppose one another; wherein the first and second arms include respective plastic surfaces interposed between the opposing first and second electrodes. Indeed, the arms may be substantially entirely formed of a plastics material. The use of plastics materials in this manner enables the apparatus to be made inexpensively and also reduces its weight.

The first and second electrodes may be formed within or integrally with a respective first and second plastic plate, the outer surfaces of which are contact surfaces for hair during the dielectric heating.

According to a fourth aspect of the invention there is provided a method of manufacturing styler apparatus for manipulating the shape of hair using dielectric heating, the method comprising: coupling first and second arms such that they are movable towards and away from one another; providing first and second electrodes on the first and second arms respectively, such that the electrodes oppose one another; and interposing respective plastic surfaces between the opposing first and second electrodes.

According to a fifth aspect of the invention there is provided first and second electrodes for use with apparatus for manipulating the shape of hair using dielectric heating, wherein: each of the electrodes comprises a first conductive region interdigitated with a second conductive region; the first conductive region of the first electrode opposes the first conductive region of the second electrode; the second conductive region of the first electrode opposes the second conductive region of the second electrode; and the first and second conductive regions of each electrode are configured to be driven with drive signals that are substantially 180 degrees out of phase with one another. As mentioned above, such an arrangement has been found to help "focus" the electric field onto the hair, providing enhanced coupling of the energy into the hair, reducing stray field lines, and also reducing potential radiofrequency emissions.

According to a sixth aspect of the invention there is provided apparatus for manipulating the shape of hair using dielectric heating, the apparatus comprising: first and second arms that are movable towards and away from one another; first and second electrodes provided on the first and second arms respectively, such that the electrodes oppose one another; and drive circuitry for supplying electrical energy to the first and second electrodes, to cause an alternating electric field to be produced in the vicinity of the electrodes in use, and thereby cause dielectric heating of hair placed between the electrodes in use; wherein the output impedance of the drive circuitry is between 1 ohm and 10 ohms (for example between 1.5 ohms and 5 ohms, such as 2 ohms). Such a low output impedance level of the drive circuitry has been found to be well matched to the capacitive impedance formed by the electrodes and the hair in use, thereby aiding coupling between the apparatus and hair.

According to a seventh aspect of the invention there is provided a method of manipulating the shape of hair using dielectric heating, the method comprising: placing hair between first and second electrodes provided on respective first and second arms of a styler apparatus, the electrodes opposing one another, and the first and second arms being movable towards and away from one another; and supplying electrical energy to the first and second electrodes via drive circuitry, to cause an alternating electric field to be produced in the vicinity of the electrodes, and thereby cause dielectric heating of the hair; wherein the output impedance of the drive circuitry is between 1 ohm and 10 ohms (for example between 1.5 ohms and 5 ohms, such as 2 ohms).

According to a eighth aspect of the invention there is provided apparatus for manipulating the shape of hair using dielectric heating, the apparatus comprising: first and second arms that are movable towards and away from one another; first and second electrodes provided on the first and second arms respectively, such that the electrodes oppose one another; drive circuitry for supplying electrical energy to the first and second electrodes, to cause an alternating electric field to be produced in the vicinity of the electrodes in use, and thereby cause dielectric heating of hair placed between the electrodes in use; and control circuitry for controlling the drive circuitry to vary the electrical energy supplied to the first and second electrodes during heating of the hair.

Such control circuitry may be configured to control the drive circuitry to vary the frequency of the electrical energy supplied to the first and second electrodes.

The apparatus may further comprise sensing circuitry for sensing a change in coupling of energy from the alternating electric field to the hair during heating of the hair, in which case the control circuitry may be configured to control the drive circuitry to vary the electrical energy supplied to the first and second electrodes in dependence upon the sensed change in coupling.

Alternatively, or in addition, the control circuitry may be configured to control the drive circuitry to vary the electrical energy supplied to the first and second electrodes according to a stored sequence of changes (for example, a factory-preset sequence of changes, or a sequence of changes determined or "learnt" by the device based on previous use and stored in a memory of the control circuitry).

According to an ninth aspect of the invention there is provided a method of manipulating the shape of hair using dielectric heating, the method comprising: placing hair between first and second electrodes provided on respective first and second arms of a styler apparatus, the electrodes opposing one another, and the first and second arms being movable towards and away from one another; supplying electrical energy to the first and second electrodes, to cause an alternating electric field to be produced in the vicinity of the electrodes, and thereby cause dielectric heating of the hair; and varying the electrical energy supplied to the first and second electrodes during the heating of the hair.

BRIEF DESCRIPTION OF THE DRAWINGS

Embodiments of the invention will now be described, by way of example only, and with reference to the drawings in which.

In the figures, like elements are indicated by like reference numerals throughout.

DETAILED DESCRIPTION OF PREFERRED EMBODIMENTS

The present embodiments represent the best ways known to the applicants of putting the invention into practice. However, they are not the only ways in which this can be achieved.

Overview of Hair Styler Employing Dielectric Heating

Figure 1:
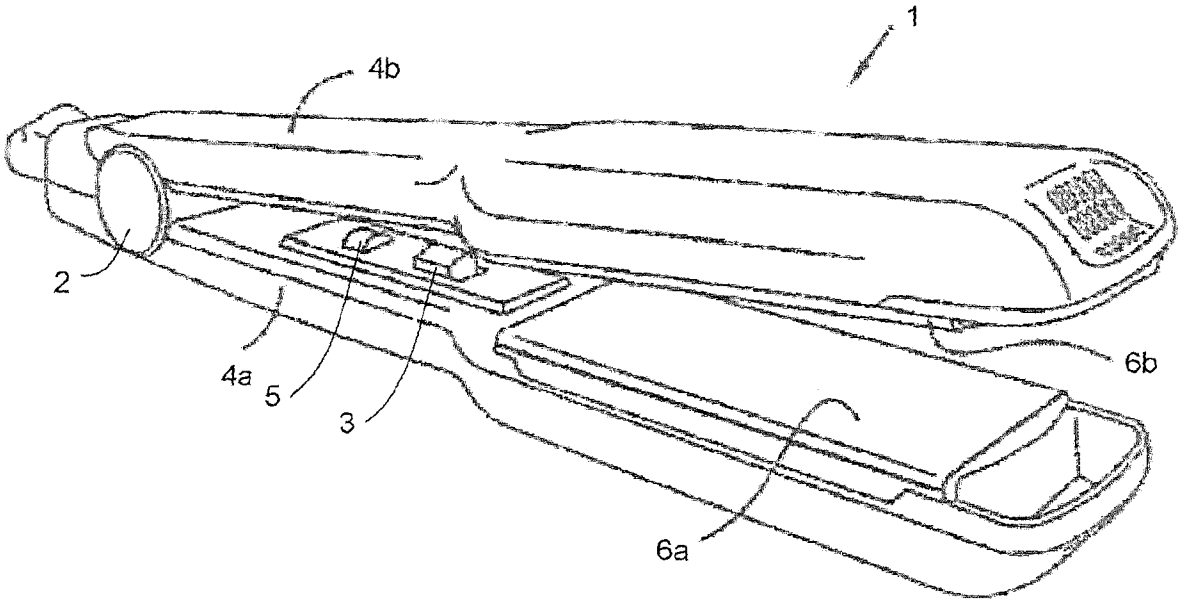
FIG. 1 illustrates a hair styler which employs dielectric heating.

FIG. 1 illustrates a hair styler 1 which employs dielectric heating. The hair styler 1 includes a first movable arm 4*a* and a second movable arm 4*b*, which are coupled together by a hinge mechanism 2. The first and second movable arms 4*a*, 4*b* oppose one another and are movable relative to one other by virtue of the hinge mechanism 2. Thus, the first and second arms 4*a*, 4*b* can be brought together, into a closed configuration, or moved apart, into an open configuration, by a user in use.

The first arm 4*a* bears a first dielectric heating plate 6*a*, and the second arm 4*b* bears a second dielectric heating plate 6*b*. The first and second dielectric heating plates 6*a*, 6*b* oppose one another and, in use, are brought together as the first and second arms 4*a*, 4*b* are brought together, or separated as the first and second arms 4*a*, 4*b* are moved apart.

The hinge mechanism 2 can incorporate any suitable means for allowing the first and second arms 4*a*, 4*b* to be moved relative to one other.

The hinge mechanism 2 also incorporates spring means configured to bias the first and second arms 4*a*, 4*b* into the open configuration, such that the user is required to apply pressure to the arms 4*a*, 4*b* to close them together (overcoming the effect of the spring means), and such that the arms 4*a*, 4*b* automatically open, under the effect of the spring means, once the pressure is removed. For example, the hinge mechanism 2 may incorporate a leaf spring or a coiled spring.

The hinge mechanism and the spring means can be one and the same. For example, the spring means itself can be used to couple the first and second arms 4*a*, 4*b* together, thereby avoiding the need to provide a separate mechanical hinge and simplifying the overall construction of the styler. For example, the first and second arms 4*a*, 4*b* may be formed in a unitary manner (e.g. from a plastics material) with a "U" shaped middle part provided between the first and second arms 4*a*, 4*b*, the "U" shaped middle part being able to resiliently flex to allow opening and closing of the heating plates 6*a*, 6*b*.

The electrical and electronic circuitry of the hair styler 1 is housed in the two arms 4*a*, 4*b*, with a switch 3 being provided on the first arm 4*a* to enable the styler 1 to be turned on or off, together with a light 5 to indicate whether the power is on. A sound can also be played by a sound generator (not illustrated) when the styler 1 is switched on and ready to use. Together, the switch 3, light 5 and sound generator (if included) form a user interface (21 in FIG. 4). In alternative embodiments the user interface may include additional components (such as, for example, further display means, to provide the user with more information on the operational status of the styler).

In use the hair is clamped between the two heating plates 6*a*, 6*b* and pulled through, in a manner similar to that of a standard styler. The heating plates 6*a*, 6*b* are pivoted such that they can freely tilt about an axis longitudinal to the body of the styler 1.

Electrodes for Causing Dielectric Heating

Figure 2:
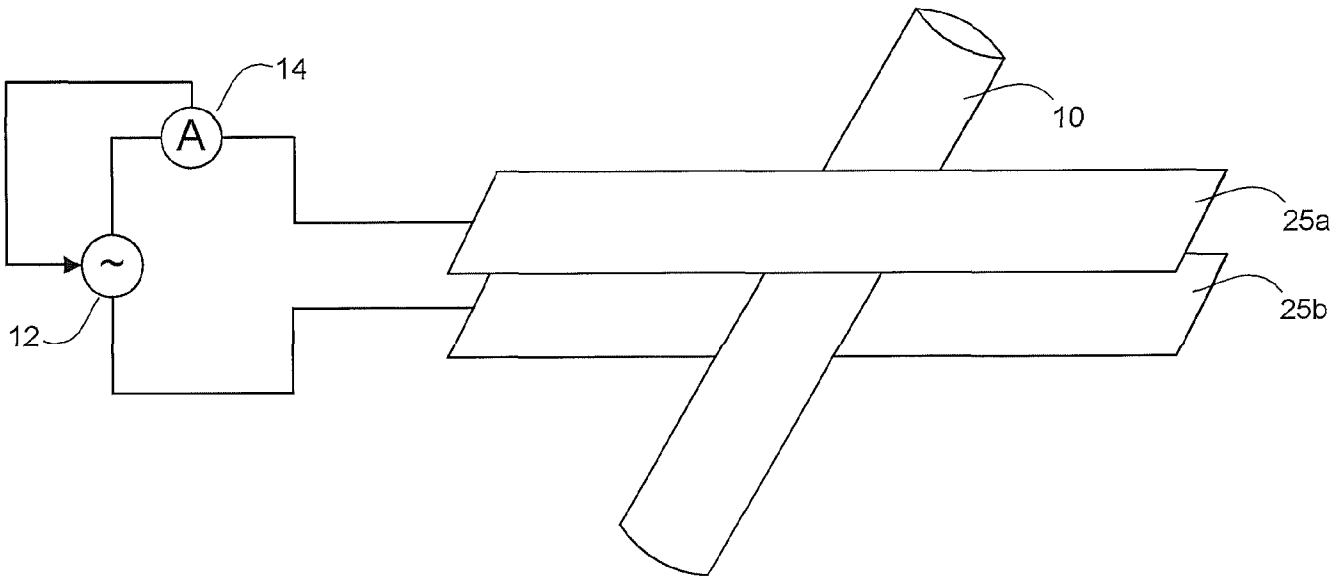
FIG. 2 is a simplified schematic circuit diagram of a hair styler as in FIG. 1, to illustrate the presence of a variable frequency alternating current source to cause an alternating electric field to be produced in the vicinity of the electrodes, and current sensing means (e.g. an ammeter) to provide feedback control to the current source.

With reference now to FIG. 2, each of the heating plates 6*a*, 6*b* includes a respective electrode 25*a*, 25*b* for causing dielectric heating of the hair 10 (reference numeral 10 in FIG. 2 being used to denote a bundle of hair rather than a single strand). As illustrated schematically in FIG. 2, in this example a variable frequency alternating current source 12 is provided to drive the electrodes 25*a*, 25*b*. The alternating current applied to the electrodes 25*a*, 25*b* causes an alternating electric field to be produced in the vicinity of (e.g. between) the electrodes 25*a*, 25*b*. Energy from the alternating electric field is coupled to the hair 10, thereby causing heating of the hair. Maximum energy coupling occurs when the frequency of the alternating electric field matches the peak absorption frequency of the hair, and when there is impedance matching between the drive circuitry (i.e. the circuitry that supplies electrical energy to the electrodes 25*a*, 25*b*) and the electrodes/hair.

In order to match the output impedance of the drive circuitry to the capacitive impedance formed by the electrodes and the hair between the electrodes, the inventors have found that the output impedance of the drive circuitry should be relatively low, of the order of 1-10 ohms and preferably about 2 ohms.

Typical frequencies of operation of the alternating current source 12 (and thus the alternating electric field produced) are in the range of 10 MHz to 100 MHz, although our experimental tests have shown that frequencies in the range of 20 MHz to 40 MHz are ideal. These frequencies are well suited for consumer products since they have limited wave propagation (unlike microwaves) and hence do not present a risk to health or undesirable EMC (electromagnetic compatibility) effects.

The electrodes 25*a*, 25*b* may themselves form the respective plates 6*a*, 6*b*, or they may be incorporated within the plates 6*a*, 6*b*.

For example, each of the plates 6*a*, 6*b* may be formed of a conductive material (e.g. aluminium), such that the plates 6*a*, 6*b* themselves act as the electrodes 25*a*, 25*b*. If the plates 6*a*, 6*b* are formed of a conductive material then the outer surface of each of the plates (i.e. the opposing surfaces of the plates 6*a*, 6*b*, against which the hair comes into contact) are coated or covered in a non-conductive material to prevent a short circuit from occurring when the plates 6*a*, 6*b* are brought together in use. The non-conductive material may be a plastics material. Alternatively, if aluminium is used to form the electrodes, then a non-conductive coating can be created on the aluminium by anodising.

Alternatively, each of the plates 6*a*, 6*b* may be formed of a non-conductive material carrying a planar conductor as the respective electrode 25*a*, 25*b*. For example, the plates 6*a*, 6*b* may be formed of a ceramic with a copper clad backing, or plastic with insert moulded metal. Again, to prevent a short circuit from occurring during use, the plates 6*a*, 6*b* are configured such that the electrodes 25*a*, 25*b* cannot come into direct contact with one another when the plates 6*a*, 6*b* are brought together.

Since the electrodes 25*a*, 25*b* do not themselves heat up to any significant extent during use of the styler 1, the opposing surfaces of the electrodes 25*a*, 25*b* (against which the hair comes into contact) may be coated in a plastics material. Furthermore, the arms 4*a*, 4*b* and/or plates 6*a*, 6*b* which support the electrodes 25*a*, 25*b* may also be formed from a plastics material, since high thermal resistance is not a requirement. Indeed, the plates 6*a*, 6*b* typically only heat up to a temperature of about 70° C. when heating hair. Furthermore, it would appear that water is not evaporated when using the present method, and hence it is likely to require less energy than conventional styling techniques.

Thus, the styler 1 can be made using lower temperature materials than those used to make conventional stylers that employ resistive heating. Such lower temperature materials (e.g. plastics) are typically less expensive than metals to obtain and form.

The shape of the electrodes 25*a*, 25*b* may be rectangular, with straight sides, as illustrated schematically in FIG. 2. Other configurations of the electrodes 25*a*, 25*b* are possible. For example, as illustrated schematically in FIG. 3, each electrode 25*a*, 25*b* may include alternating interdigitated conductive regions of "positive" electrode and "negative" electrode, the interdigitated regions being arranged such that when the plates 6*a*, 6*b* are bought together, a "positive" electrode region of the first plate 6*a* opposes a "negative" electrode region of the second plate 6*b*, and a "negative" electrode region of the first plate 6*a* opposes a "positive" electrode region of the second plate 6*b* (as denoted by the "+" and "−" symbols in FIG. 3). Naturally, as those skilled in the art will appreciate, the use of the terms "positive" and "negative" in this context is merely to enable the constituent regions of each electrode 25*a*, 25*b* to be distinguished from one another; in practice the constituent regions will both be subjected to an alternating current, with the constituent regions being driven out of phase with one another. The use of interdigitated electrodes in this manner helps to "focus" the electric field onto the hair, providing enhanced coupling of the energy into the hair, reducing stray field lines, and also reducing potential radiofrequency emissions.

Figure 3:
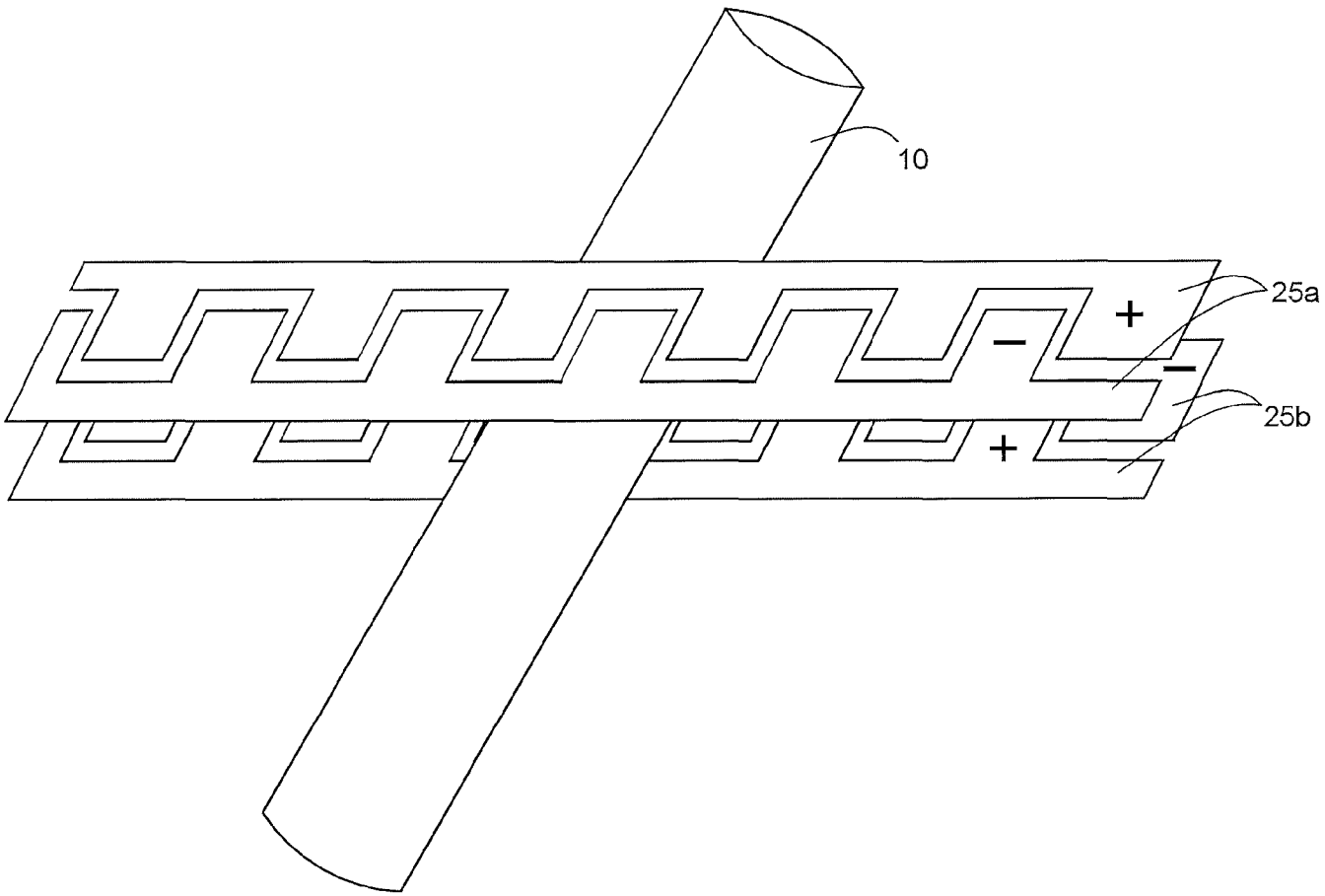
FIG. 3 illustrates an alternative configuration of the electrodes, wherein each electrode includes alternating interdigitated regions.

It should be appreciated that the illustration in FIG. 3 is merely schematic, and that, in practice, the interdigitated "fingers" of the "positive" and "negative" electrode regions may be much narrower than is illustrated, such that a plurality of interdigitated fingers span the width of a typical bundle of hair 10. Alternatively, the interdigitated fingers may be wider, e.g. as illustrated or wider still.

Furthermore, the extent to which the interdigitated fingers pass alongside one another may be less than, or greater than, that as illustrated.

Electrical Circuitry

As illustrated schematically in FIG. 2, the styler 1 is provided with electrical circuitry configured to provide feedback control to the variable frequency alternating current source 12, such that the frequency of the alternating current is tuned to the peak absorption frequency of the hair as it changes during the heating process.

In a general sense, the feedback control provides means for varying the frequency of the alternating current supplied by the alternating current source 12, for determining which frequency of the supplied alternating current provides good coupling (preferably maximum coupling) of the alternating electric field (as produced in the vicinity of the electrodes 25*a*, 25*b*) to the hair, and for adjusting the frequency of the alternating current supplied by the alternating current source 12 so as to be at or around the determined frequency.

In view of the fact that the peak absorption frequency of the hair varies over time (e.g. as the moisture content of the hair decreases) and that the peak absorption frequency can also vary due to other factors such as the packing density of the hair, during use of the styler 1 the feedback control causes the frequency of the alternating current to be repeatedly tuned (or retuned) to the peak absorption frequency of the hair.

With the embodiment illustrated in FIG. 2, the feedback control is performed by current sensing means 14 (e.g. an ammeter or other means for measuring current) arranged to sense the current being drawn from the drive circuitry by the electrodes 25*a*, 25*b*. A feedback signal from the current sensing means 14, representative of the magnitude of the current being drawn from the drive circuitry, is used to control the alternating current source 12.

In broad terms the feedback control operates on the principle that, when the frequency of the alternating current provided by the variable frequency alternating current source 12 is tuned to the peak absorption frequency of the hair 10, such that the alternating electric field (as produced in the vicinity of the electrodes 25*a*, 25*b*) couples well to the hair, the magnitude of the current drawn from the drive circuitry by the electrodes 25*a*, 25*b* will be significantly greater than when the frequency of the alternating current is not tuned to the peak absorption frequency of the hair and coupling is not occurring or is not occurring to the same extent. For example, the magnitude of the current drawn from the drive circuitry during coupling may be around 2A whereas when the alternating current is not tuned to the peak absorption frequency of the hair, the current drawn may fall to around 20 mA.

Accordingly, the output from the current sensing means 14, as fed back to the current source 12, is used to control the frequency of the alternating current produced by the current source 12, and thereby tune the frequency of the alternating current to the peak absorption frequency of the hair 10. When the frequency of the alternating current is tuned to the peak absorption frequency of the hair (as at that point in time) energy from the alternating electric field (as produced in the vicinity of the electrodes 25*a*, 25*b*) is coupled to the hair 10.

The circuitry shown in FIG. 2 is somewhat simplified, in order to illustrate the principle of tuning the frequency of the alternating current that is applied to the electrodes, to achieve coupling of the alternating electric field with the hair.

Figure 4:
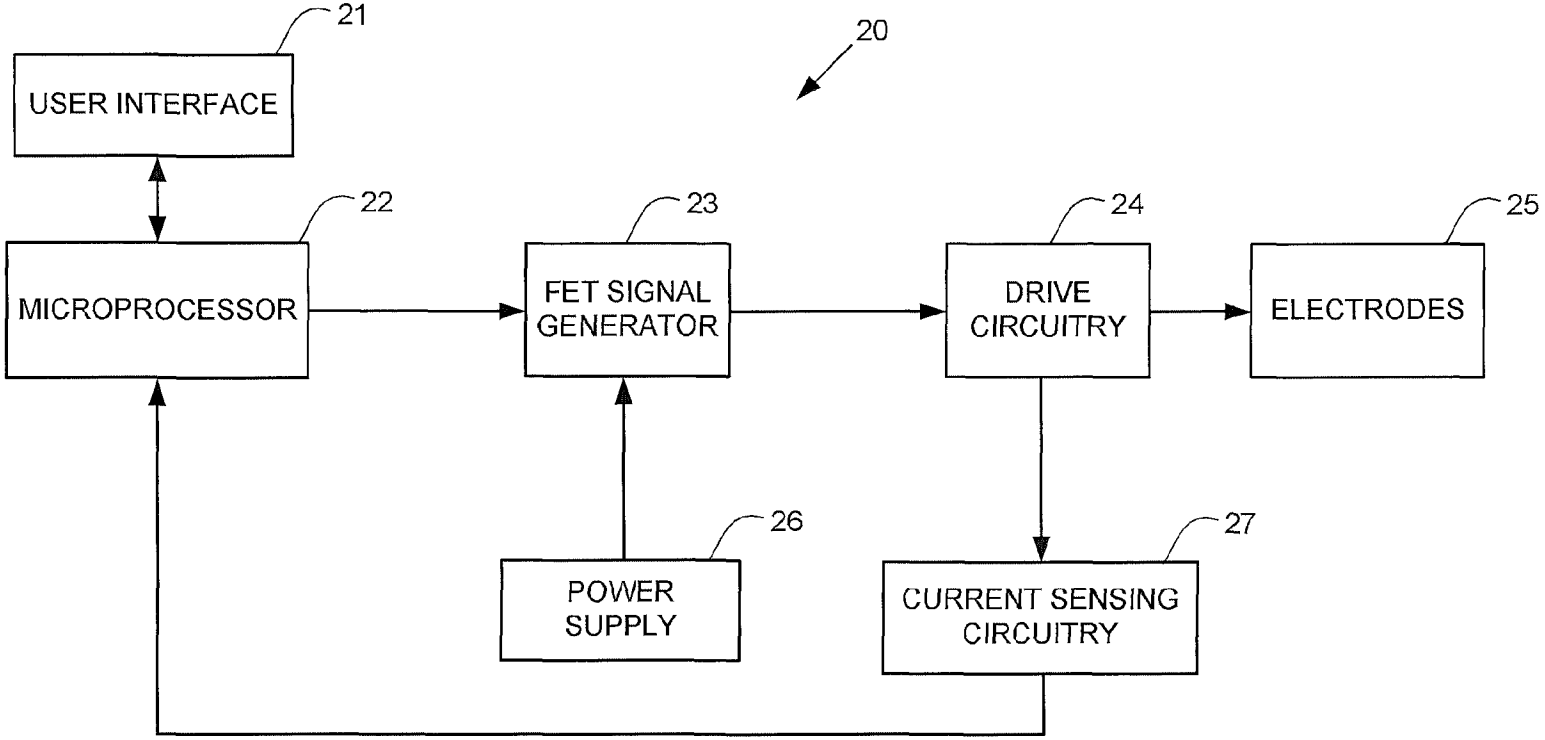
FIG. 4 illustrates possible electrical circuitry for use in the hair styler of FIG. 1.

FIG. 4 illustrates in more detail electrical circuitry 20 suitable for use in the above embodiment of the styler 1. The electrical circuitry 20 includes a user interface 21, microprocessor 22, FET (field effect transistor) signal generator 23, drive circuitry 24, power supply 26, current sensing circuitry 27, and the above-described electrodes 25.

The user interface 21 is as described above in relation to FIG. 1, and typically includes a switch 3 to enable the styler 1 to be turned on or off, and indicator means such as light 5 to indicate whether the power is on and whether the styler is ready to use.

The microprocessor 22 is programmed and configured to control the operation of the styler 1, including the tuning of the frequency of the applied alternating current to the peak absorption frequency of the hair.

The FET signal generator 23 is configured to receive electrical power from the power supply 26 and to provide an alternating voltage having a set frequency to the drive circuitry 24. The frequency of the alternating voltage provided by the FET signal generator 23 is controlled (or set) by the microprocessor 22.

In the presently-preferred embodiment the power supply 26 is a mains power supply, in which case the FET signal generator 23 is configured to down-convert the mains AC electricity from around 230-240V to around 50V AC, e.g. using a switch mode system as will be familiar to those skilled in the art. In an alternative embodiment the power supply 26 comprises one or more DC batteries or cells (which may be rechargeable, e.g. from the mains via a charging lead). This enables the styler 1 to be a cordless product. In such an embodiment the FET signal generator 23 is configured to up-convert the DC voltage from the batteries/cells to around 50V AC.

The drive circuitry 24 is configured to receive the alternating voltage from the FET signal generator 23 and to apply it across the electrodes 25 of the plates 6*a*, 6*b*. This causes a corresponding AC current to flow from the drive circuitry 24 into the electrodes 25.

In a presently-preferred embodiment the drive circuitry 24 includes a switch that is activated (e.g. closed) when the arms 4*a*, 4*b* have been brought together and the plates 6*a*, 6*b* are closed. The drive circuitry 24 is configured to only apply energy to the electrodes 25 when the plates 6*a*, 6*b* are closed and the switch has been activated, thus providing a safety feature to the styler 1. As those skilled in the art will appreciate, other detection means may be used instead of a switch for this purpose, such as an optical interlock arrangement, or electrical contacts that come together when the plates 6*a*, 6*b* are closed.

Current sensing circuitry 27 is coupled to the drive circuitry 24 (e.g. to an output of the drive circuitry 24), and is configured to sense the current output from the drive circuitry 24 and applied to the electrodes 25. An output signal from the current sensing circuitry 27, representative of the magnitude of this current, is fed back to the microprocessor 22. As discussed in relation to FIG. 2 above, when the frequency of the alternating current is tuned to the peak absorption frequency of the hair, the magnitude of the current being drawn from the drive circuitry 24 by the electrodes 25 will be significantly greater than when the frequency of the alternating current is not tuned to the peak absorption frequency of the hair. Accordingly, the output from the current sensing means 14, as fed back to the microprocessor 22, is used by the microprocessor 22 to control the frequency of the alternating voltage produced by the FET signal generator 23, and thereby tune the frequency of the alternating current to the peak absorption frequency of the hair 10.

Figure 5:
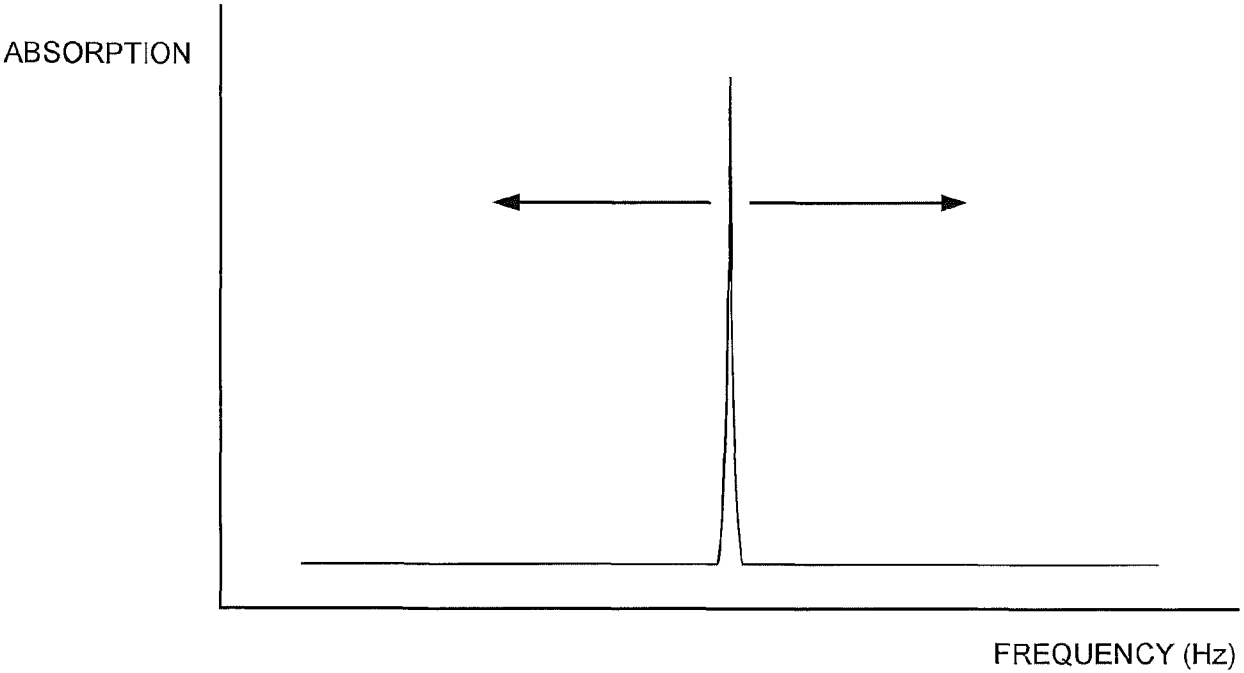
FIG. 5 illustrates a plot of absorption level against frequency of applied alternating electric field, in respect of the dielectric heating of hair, and showing that the absorption peak is variable.

As mentioned above, and as illustrated schematically in FIG. 5, the frequency and size of the absorption peak of the hair varies with the dampness of the hair, and also with the packing density of the hair. Hence the absorption frequency is tracked throughout the styling process to ensure optimal coupling of energy into the hair during the styling process. This can be achieved in a number of ways:

- Use of spread spectrum techniques to provide a wide band of active frequencies of the alternating current (e.g. between 20 MHz and 40 MHz) as applied to the electrodes 25. The microprocessor 22 causes the alternating voltage produced by the signal generator 23 to jump around in frequency (i.e. employing a frequency hopping technique, which may be performed according to a predetermined pattern or sequence, e.g. pseudo-randomly). For each frequency the current sensing circuitry 27 senses the current drawn from the output amplifier (not shown) of the drive circuitry 24 by the electrodes 25 and provides a signal to the microprocessor 22 that is representative of the magnitude of the sensed current. The frequency of the applied alternating current which produces a peak in the sensed current is determined by the microprocessor 22, and that frequency (or a nearby frequency) is then used for a period of time which typically will be between 10 ms and 1 s, before the search is repeated across the said band of frequencies.
- Use of a scanning signal across the range of active frequencies (e.g. from 20 MHz to 40 MHz, repeatedly). The microprocessor 22 causes the frequency of the alternating voltage produced by the signal generator 23 to be varied in a continuous (sweeping) manner across the range of active frequencies. For each frequency the current sensing circuitry 27 senses the current drawn from the drive circuitry 24 by the electrodes 25 and provides a signal to the microprocessor 22 that is representative of the magnitude of the sensed current. The frequency of the applied alternating current which produces a peak in the sensed current is determined by the microprocessor 22, and that frequency (or a nearby frequency) is then used for a period of time, before the search is repeated across the said band of frequencies.
- Use of two signals substantially simultaneously: a low amplitude test signal to determine or update the peak absorption frequency (e.g. using either frequency hopping or scanning as outlined above), whilst substantially simultaneously providing a main drive signal to the electrodes 25*a*, 25*b* at the most recently determined frequency to cause heating of the hair.

Modifications and Alternatives

Detailed embodiments have been described above. As those skilled in the art will appreciate, a number of modifications and alternatives can be made to the above embodiments whilst still benefiting from the inventions embodied therein. By way of illustration only some of these alternatives and modifications will now be described.

In the above embodiments the current used to drive the electrodes, to cause an alternating electric field to be produced in the vicinity of the electrodes, is supplied by a variable frequency alternating current source 12 or a variable frequency alternating voltage source such as FET signal generator 23. However, in alternative embodiments a DC source can be used, together with switching circuitry that repeatedly reverses the polarity of voltage/current applied to each of the electrodes, thereby causing an alternating electric field to be produced in the vicinity of the electrodes.

Figure 6:
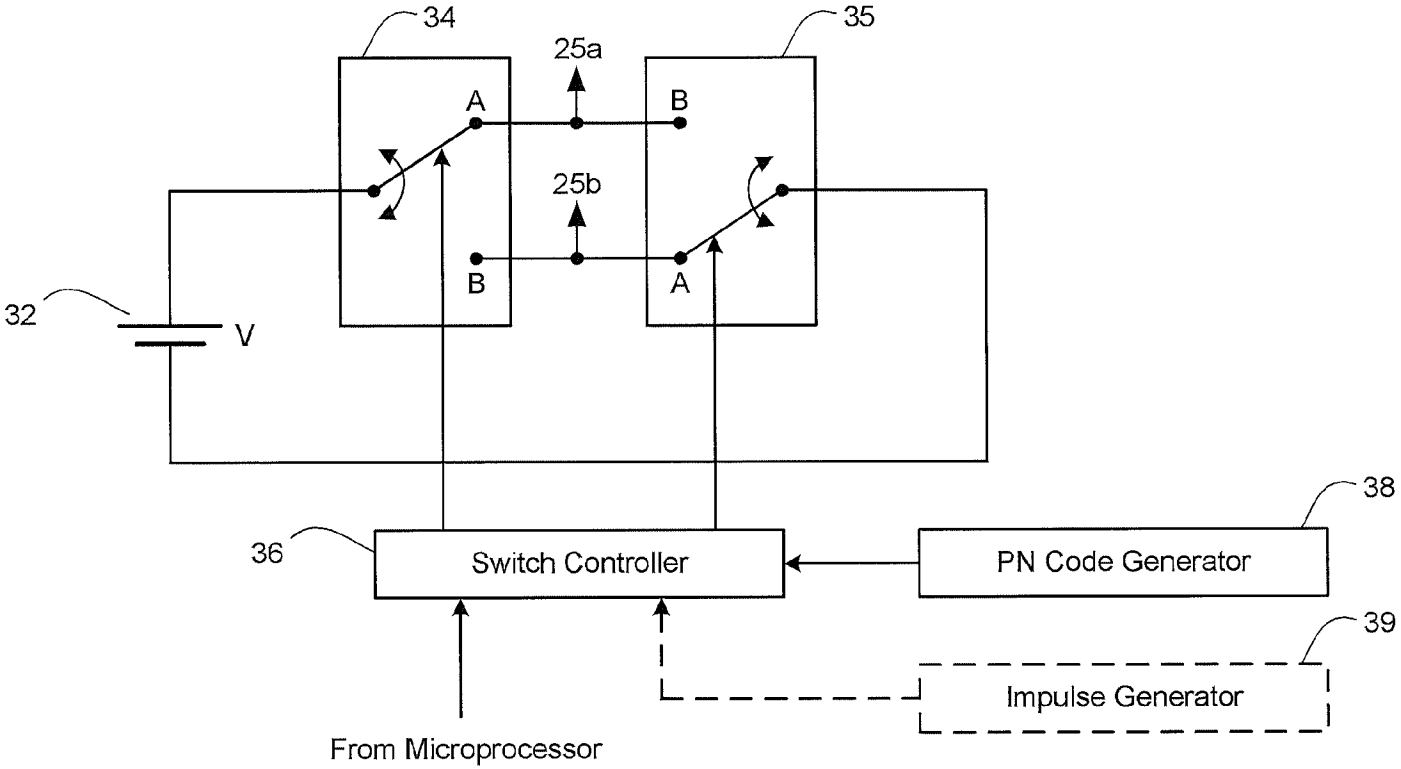
FIG. 6 illustrates an alternative drive circuit to that of FIG. 2, the drive circuit of FIG. 6 incorporating a DC power supply and switching circuitry to repeatedly reverse the polarity of voltage applied to each of the electrodes in order to cause an alternating electric field to be produced in the vicinity of the electrodes.

Such an arrangement is illustrated in FIG. 6, where DC voltage source 32 is coupled to high frequency switches 34 and 35. Switches 34 and 35 are each reversibly switchable between a terminal A and a terminal B, under the control of switch controller 36, and in synchronicity with one another. Terminal A of switch 34 and terminal B of switch 35 are both connected to electrode 25*a*, whereas terminal B of switch 34 and terminal A of switch 35 are both connected to electrode 25*b*. When the switches 34, 35 are both in position A (as illustrated), electrode 25*a* is connected to the positive terminal of the DC voltage source 32, and electrode 25*b* is connected to the negative terminal of the DC voltage source. Conversely, when the switches 34, 35 are both in position B, electrode 25*a* is connected to the negative terminal of the DC voltage source 32, and electrode 25*b* is connected to the positive terminal of the DC voltage source. In such a manner, the polarity of the voltage applied to each of the electrodes 25*a*, 25*b* can be repeatedly reversed, in order to cause an alternating electric field to be produced in the vicinity of the electrodes 25*a*, 25*b*. The timing of the switching events for the main drive signal is controlled by the microprocessor 22 as before. If a wide band test signal is to be applied (for tracking the best drive frequency to use), then the timing of the switching events can be determined, for example, by a PN (pseudo noise) code generator 38, which is configured to supply a PN code to the switch controller 36. As a further alternative to generating a wideband signal, an impulse generator 39 (illustrated in phantom) may be provided to control the position of the switches 34, 35. In this case, an impulse generated by the impulse generator 39 causes the switch controller 36 to quickly change the positions of the switches 34 and 35 to cause a short burst of alternating voltage to be applied to the electrodes 25. By analysing the current drawn by the electrodes 25 as a result of this short burst, the system can determine the optimum frequency at which to drive the electrodes for maximum energy coupling into the hair.

In the above embodiments the frequency of the supplied alternating current which causes the best energy coupling of the alternating electric field to the hair is determined. The analysis to make this determination can be performed in the time domain or in the frequency domain. In embodiments that sense the magnitude of multiple frequencies applied at the same time, this analysis is preferably done using frequency domain techniques (rather than trying to use time domain filtering techniques to separate the different frequency components).

For example, with reference back to FIG. 2, in place of an ammeter 14, a frequency domain analyser may be provided, to analyse the frequencies present in the wideband current applied to the electrodes 25. In more detail, the applied current may be analysed in the frequency domain by a frequency domain analyser (e.g. a processor running a Fast Fourier Transform (FFT) algorithm). The frequency domain analyser is configured to determine, via frequency analysis, the frequency of the current component that has the largest amplitude. That frequency (or a nearby frequency) is then identified as the frequency at which the electrodes 25 are then to be driven, and the drive frequency of the main drive signal is adjusted accordingly.

In the above embodiments sensing circuitry is provided which comprises means for determining a frequency of the electrical energy at which better coupling of the alternating electric field to the hair takes place than with other frequencies; and the control circuitry is configured to control the drive circuitry to adjust the frequency of the electrical energy so as to be at or around the determined frequency. However, in other alternative embodiments control circuitry may be configured to vary the electrical energy supplied to the first and second electrodes without the use of such sensing circuitry, and without determining during use the frequency of the electrical energy at which better coupling of the alternating electric field to the hair takes place. For example, the control circuitry may be configured to vary the electrical energy supplied to the electrodes according to a stored sequence of changes. Such a stored sequence of changes may be, for example, a factory-pre-set sequence of changes; different sequences of changes according to hair type or the kind of styling to be carried out may be pre-programmed into the device. Alternatively a typical sequence of changes may be determined or "learnt" by the device based on previous use (e.g. in respect of a particular user and their hair) and stored in a memory of the device. Whilst these techniques may not be as effective as the use of sensing circuitry and active feedback control to the drive circuitry, they nevertheless enable the electrical energy supplied to the electrodes to be varied during use, compensating for variation in the peak absorption frequency of the hair during styling.

A person skilled in the art will appreciate that the techniques we have described above may be employed for a range of hair styling appliances including, but not limited to, a hair straightener, a hair crimping device, and a hair curler.

No doubt many other effective alternatives will occur to the skilled person. It will be understood that the invention is not limited to the described embodiments and encompasses modifications apparent to those skilled in the art lying within the scope of the claims appended hereto.

Throughout the description and claims of this specification, the words "comprise" and "contain" and variations of the words, for example "comprising" and "containing", means "including but not limited to", and is not intended to (and does not) exclude other components, integers or steps.

The invention claimed is:

1. A hair styling apparatus comprising:

first and second arms that are movable towards and away from one another;

first and second electrodes provided on the first and second arms respectively, such that the first and second electrodes oppose one another;

drive circuitry for supplying current to the first and second electrodes, to cause an alternating electric field to be produced in vicinity of the electrodes in use, and thereby cause dielectric heating of hair placed between the electrodes in use;

current sensing circuitry that senses the current applied to the first and second electrodes;

a microprocessor that receives an output signal from the current sensing circuitry, that determines, from changes in the output signal, a change in coupling of an electrical energy from the alternating electric field to the hair during the dielectric heating of the hair and that controls the drive circuitry to vary the current supplied to the first and second electrodes in dependence upon the determined change in coupling of energy from the alternating electric field to the hair during the dielectric heating of the hair.

2. The hair styling apparatus as claimed in claim 1, wherein the microprocessor determines from the output signal from the current sensing circuitry a frequency of the electrical energy at which better coupling of the alternating electric field to the hair takes place than with other frequencies and controls the drive circuitry to adjust the frequency of the electrical energy so as to be at or around the determined frequency.

3. The hair styling apparatus as claimed in claim 2, wherein the microprocessor determines the frequency of the electrical energy at which better coupling of the alternating electric field to the hair takes place by determining the frequency of the supplied electrical energy at which a magnitude of the sensed current is at a peak.

4. The hair styling apparatus as claimed in claim 3, wherein the output signal from the current sensing circuitry is representative of the magnitude of the current drawn by the first and second electrodes;

wherein the microprocessor is configured: i) to cause the drive circuitry to vary the frequency of the electrical energy; ii) to receive said output signal from the current sensing circuitry in respect of each of a plurality of frequencies and thereby determine the frequency of the electrical energy at which the peak in the sensed current is obtained; and iii) to cause the drive circuitry to supply the electrical energy at or around the determined frequency for a period of time.

5. The hair styling apparatus as claimed in claim 4, wherein the microprocessor is configured to cause the drive circuitry to generate a test signal or test signals comprising different frequency components whilst substantially simultaneously supplying electrical energy to the first and second electrodes at the determined frequency to cause the dielectric heating of the hair.

6. The hair styling apparatus as claimed in claim 5, wherein the test signal or test signals are at a low amplitude relative to the electrical energy supplied at the determined frequency.

7. The hair styling apparatus as claimed in claim 1, wherein the microprocessor is configured to control the drive circuitry to vary a frequency of the electrical energy supplied to the first and second electrodes.

8. The hair styling apparatus as claimed in claim 7, wherein the microprocessor is configured to vary the frequency of the electrical energy using a frequency hopping technique across a range of frequencies or in a sweeping manner across a range of frequencies.

9. The hair styling apparatus as claimed in claim 7, wherein the microprocessor is configured to apply a test signal to the first and second electrodes comprising a plurality of frequencies simultaneously.

10. The hair styling apparatus as claimed in claim 1, further comprising means for detecting whether the first and second arms are closed together and means for cutting off the supply of electrical energy to the first and second electrodes if the first and second arms are not detected as being closed together.

11. The hair styling apparatus as claimed in claim 1, wherein the first arm bears a first dielectric heating plate, and the second arm bears a second dielectric heating plate, the first dielectric heating plate incorporating the first electrode and the second dielectric heating plate incorporating the second electrode.

12. The hair styling apparatus as claimed in claim 11, wherein at least the first dielectric heating plate has a plastic outer surface which forms a contact surface for hair sandwiched between the first and second dielectric heating plates during use.

13. The hair styling apparatus as claimed in claim 1, wherein:

each of the first and second electrodes comprises a first conductive region interdigitated with a second conductive region;

the first conductive region of the first electrode opposes the first conductive region of the second electrode;

the second conductive region of the first electrode opposes the second conductive region of the second electrode; and the drive circuit is configured to drive the first and second conductive regions of each electrode with the current that are substantially 180 degrees out of phase with one another.

* * * * *